US007568830B2

(12) United States Patent
Hsu

(10) Patent No.: US 7,568,830 B2
(45) Date of Patent: Aug. 4, 2009

(54) LED HOLDER

(75) Inventor: Sheng-Hung Hsu, Kaohsiung Hsien (TW)

(73) Assignee: Gemmy Industries Corporation, Coppell, TX (US)

( * ) Notice: Subject to any disclaimer, the term of this patent is extended or adjusted under 35 U.S.C. 154(b) by 153 days.

(21) Appl. No.: 11/724,401

(22) Filed: Mar. 15, 2007

(65) Prior Publication Data

US 2008/0227327 A1 Sep. 18, 2008

(51) Int. Cl.
*H01R 33/00* (2006.01)

(52) U.S. Cl. ..... 362/655; 362/311; 362/363; 361/820

(58) Field of Classification Search ..... 362/311, 362/363, 655; 361/820
See application file for complete search history.

(56) References Cited

U.S. PATENT DOCUMENTS 4,667,270 A * 5/1987 Yagi ..... 361/820
5,121,311 A * 6/1992 Cheselske ..... 362/249
6,781,695 B2 * 8/2004 Hovan et al. ..... 356/437
7,322,736 B2 * 1/2008 Lee et al. ..... 362/655

* cited by examiner

*Primary Examiner*—Stephen F Husar
*Assistant Examiner*—James W Cranson
(74) *Attorney, Agent, or Firm*—William E. Pelton, Esq.; Cooper & Dunham LLP

(57) ABSTRACT

An LED holder has a housing, a disc mounted in a lower end of the housing, a seat formed on the disc, a pair of sockets formed in the seat and a bracket mounted detachably on the seat to hole the LED. Hence, the LED is assembled and disassembled easily.

8 Claims, 4 Drawing Sheets

LED HOLDER

BACKGROUND OF THE INVENTION

1. Field of the Invention

The present invention relates to an LED holder, and more particularly to an LED holder that is assembled and disassembled easily.

2. Description of the Related Art

An LED is mounted into a conventional holder that is undetachable. When the LED is damaged and needs to be replaced, the conventional holder also needs to be replaced. Thus, the undamaged conventional holder is wasted.

Therefore, the invention provides an LED holder to mitigate or obviate the aforementioned problems.

SUMMARY OF THE INVENTION

The main objective of the present invention is to provide an LED holder that is assembled and disassembled easily.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
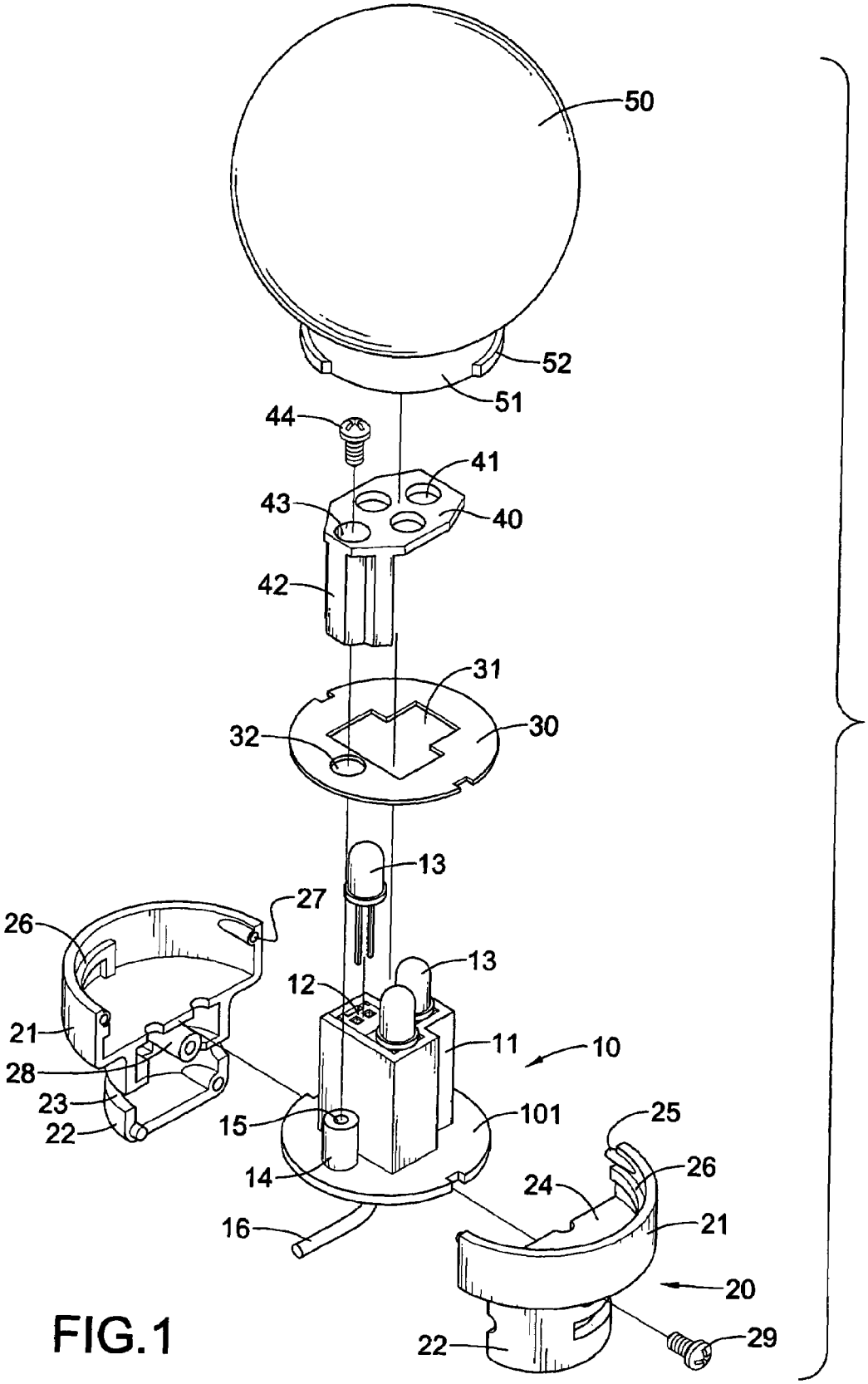
FIG. 1 is an exploded perspective view of an LED holder in accordance with the present invention with a lamp shell.
Figure 2:
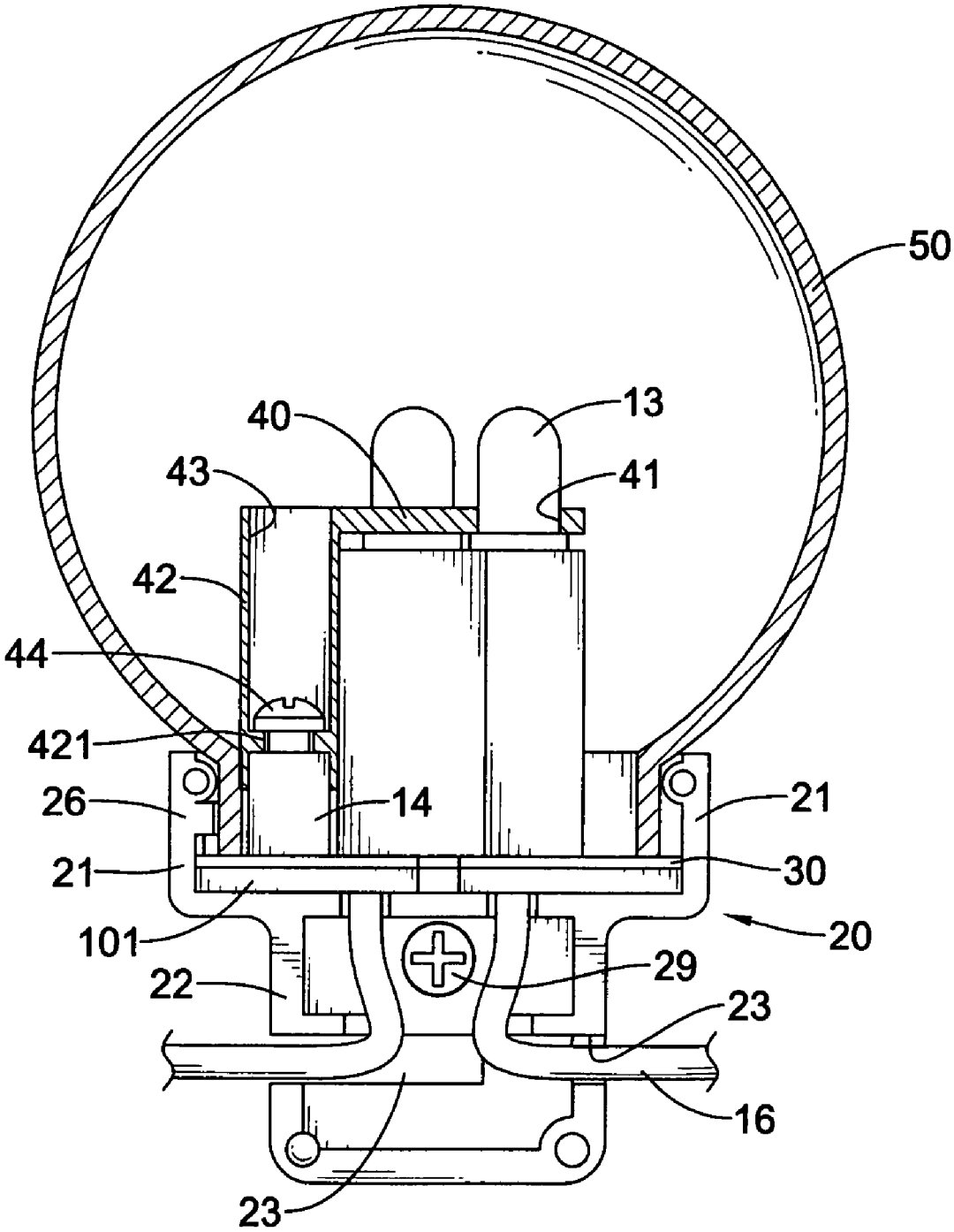
FIG. 2 is a side view in cross section of the LED holder in FIG. 1 with the lamp shell.
Figure 3:
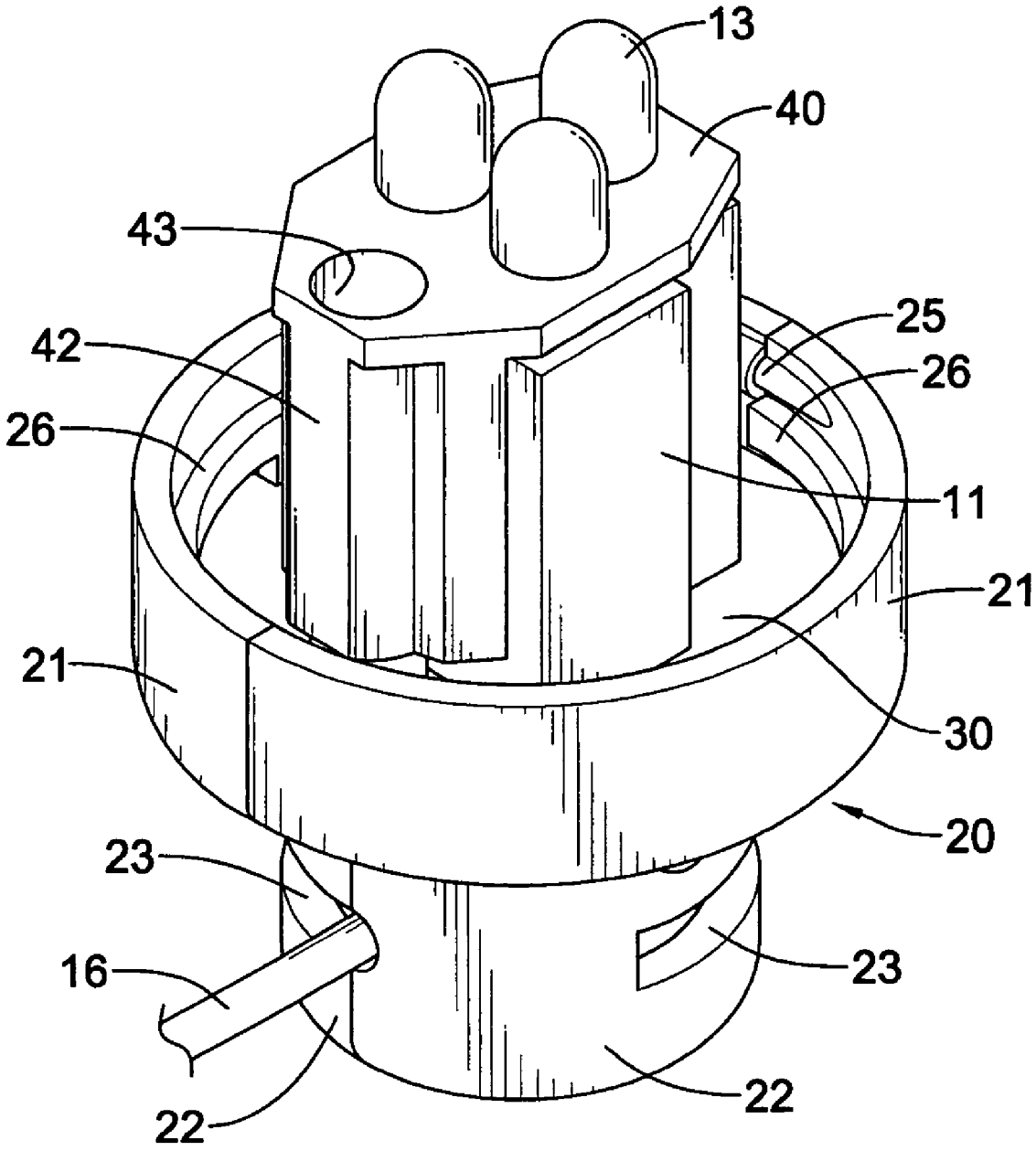
FIG. 3 is a perspective view of the LED holder in FIG. 1.
Figure 4:
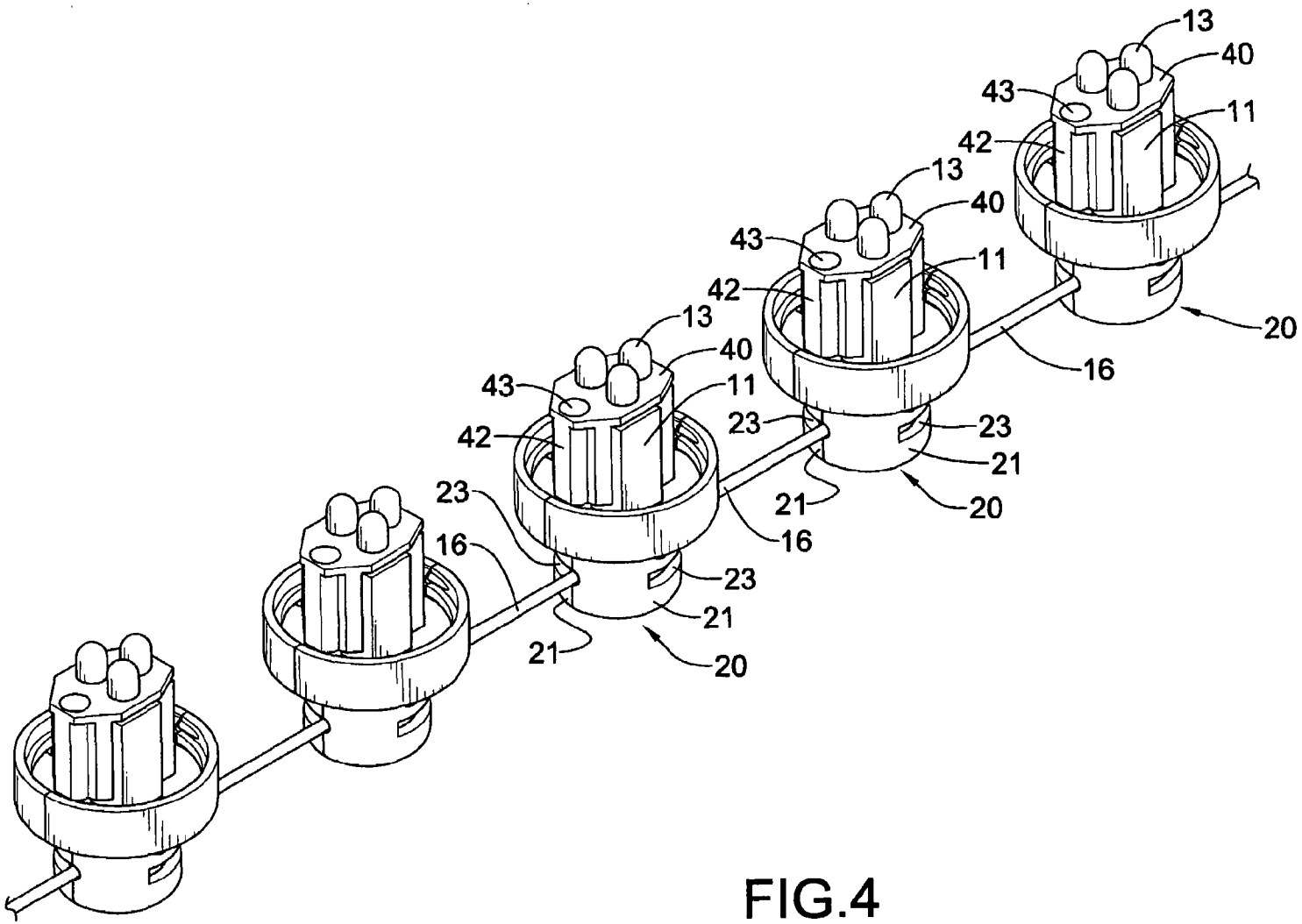
FIG. 4 is a perspective view of multiple LED holders in FIG. 1 arranged in series connection.

With reference to FIGS. 1 to 4, an LED holder in accordance with the present invention holds at least one LED (13) and has a base (10) and two half-housings (20).

The base (10) comprises a disc (101), a seat (11) and a mounting sleeve (14). The seat (11) is formed on the disc (101) and has at least one pair of sockets (12) formed in the seat (11). The mounting sleeve (14) is formed on the disc (101) and has a threaded hole (15) formed in the mounting sleeve (14). A wire (16) electrically connects to the sockets (12) to electrically connect the sockets (12) to the power supply.

The half-housings (20) are mounted around the base (10). Each half-housing (20) has a shelf (24) provided in a middle end thereof, a wall (21) mounted around the shelf (24), a semi-sphere arcuate body (22) mounted under the shelf (22), a channel (23) defined in the arcuate body (22), a flange (26) and two bars (25) and two holes (27). The flange (26) is formed on the wall (21). The bars (25) are formed on the wall (21) and are opposite to each other. The holes (27) are formed respectively in the bars (25). A lock pin (28) is formed in one of the half-housing. A screw is inserted into the lock pin (28) to hold the two half-housings (20) together. The base (10) is mounted between the half-housings (20) and is mounted between the shelves (24) and the flanges (26) so that the half-housings (20) can hold the base (10) and the wire (16) can be extended out from the channel (23).

The bracket (40) is mounted on the seat (11) to hold the LEDs (13) and has multiple through holes (41) formed through the bracket (40), aligns with the corresponding pair of sockets (12) and mounted around the LEDs (13). A foot (42) is extended out of the bracket (40) and a passage (43) is formed through the bracket (40) near the foot (42) and aligns the mounting sleeve (14). A tab (421) is provided in the passage (43) so that a screw (44) is put into the passage (43), extends through the tab (421) and is screwed into the threaded hole (15).

An insulating washer (30) is attached to the disc (101) and has an opening (31) defined in a middle portion thereof and an aperture (32) defined in a periphery thereof. The opening (31) of the washer (30) is mounted around the seat (11). The aperture (32) is mounted around the post (14).

A lamp shell (50) is mounted on the top of the LED holder as described and has a neck (51) formed on the lamp shell (50). The neck (51) can be engaged with the shelf (24) and the flange (26) and the lamp shell (50) can be positioned on the half-housings (20).

The bracket (40) can be detached to replace the LEDs (13). Hence, the LED holder in accordance with the present invention is assembled and disassembled easily.

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. An LED holder comprising:

two half-housings;

a disc mounted between the half-housings;

a seat formed on the disc;

at least one pair of sockets formed in the seat;

a wire electrically connecting to the sockets;

a bracket is mounted detachably on the seat adapted for holding LED;

a foot extending out of the bracket;

a passage formed through the bracket near the foot;

a tab provided in the passage;

a mounting sleeve formed on the disc and having a threaded hole aligning to the passage; and a screw put into the passage, extending through the tab and screwed into the threaded hole in the mounting sleeve.

2. The LED holder as claimed in claim 1, wherein the bracket has at least one through hole formed through the bracket and aligning with a corresponding pair of sockets.

3. The LED holder as claimed in claim 2, wherein each half-housing has a shelf provided in a middle end of the half-housing;

a wall mounted around the shelf;

a semi-sphere arcuate body mounted under the shelf;

a channel defined in the arcuate body;

a flange formed on the wall;

two bars formed on the wall opposite to each other;

two holes formed respectively in the bars;

a lock pin formed in one of the half-housing; and a screw inserted into the lock pin;

the base is mounted between the half-housings and is mounted between the shelves and the flanges; and the wire extends out from the channel.

4. The LED holder as claimed in claim 3 further comprising an insulating washer attached to the disc and having an opening defined in a middle portion of the insulating washer and mounted around the seat; and an aperture defined in a periphery of the insulating washer and mounted around the post.

5. The LED holder as claimed in claim 2 further comprising an insulating washer attached to the disc and having an opening defined in a middle portion of the insulating washer and mounted around the seat; and an aperture defined in a periphery of the insulating washer and mounted around the post.

6. The LED holder as claimed in claim 1, wherein each half-housing has a shelf provided in a middle end of the half-housing;

a wall mounted around the shelf;

a semi-sphere arcuate body mounted under the shelf;

a channel defined in the arcuate body;

a flange formed on the wall;

two bars formed on the wall opposite to each other;

two holes formed respectively in the bars;

a lock pin formed in one of the half-housing; and a screw inserted into the lock pin;

the base is mounted between the half-housings and is mounted between the shelves and the flanges; and the wire extends out from the channel.

7. The LED holder as claimed in claim 6 further comprising an insulating washer attached to the disc and having an opening defined in a middle portion of the insulating washer and mounted around the seat; and an aperture defined in a periphery of the insulating washer and mounted around the post.

8. The LED holder as claimed in claim 1 further comprising an insulating washer attached to the disc and having an opening defined in a middle portion of the insulating washer and mounted around the seat; and an aperture defined in a periphery of the insulating washer and mounted around the post.

* * * * *